US006209802B1

(12) United States Patent
Koivunen

(10) Patent No.: US 6,209,802 B1
(45) Date of Patent: Apr. 3, 2001

(54) SPINNING WASH NOZZLE ASSEMBLY

(75) Inventor: Erkki A. Koivunen, Northville, MI (US)

(73) Assignee: InterClean Equipment, Inc., Ann Arbor, MI (US)

( * ) Notice: Subject to any disclaimer, the term of this patent is extended or adjusted under 35 U.S.C. 154(b) by 0 days.

(21) Appl. No.: 09/446,929

(22) PCT Filed: Jun. 29, 1998

(86) PCT No.: PCT/US98/13928

§ 371 Date: May 12, 2000

§ 102(e) Date: May 12, 2000

(87) PCT Pub. No.: WO99/00195

PCT Pub. Date: Jan. 7, 1999

Related U.S. Application Data

(60) Provisional application No. 60/051,193, filed on Jun. 30, 1997, and provisional application No. 60/057,301, filed on Sep. 2, 1997.

(51) Int. Cl.[7] ..... B05B 3/06

(52) U.S. Cl. ..... 239/252; 239/75; 239/251; 239/263.3; 134/112; 134/179; 137/468; 236/93 R

(58) Field of Search ..... 239/75, 251, 252, 239/256, 259, 262, 263.3; 134/112, 179; 137/468; 236/93 A, 93 R, 99 R

(56) References Cited

U.S. PATENT DOCUMENTS

| | | | | |
|---|---|---|---|---|
| 2,108,787 | * | 2/1938 | Coles et al. | 239/252 X |
| 2,784,034 | * | 3/1957 | Metcalf | 239/252 X |
| 2,865,672 | * | 12/1958 | Guinard | 239/252 |
| 4,440,345 | * | 4/1984 | Figwer et al. | 239/252 X |
| 5,020,556 | * | 6/1991 | Lamminen et al. | 239/252 X |

* cited by examiner

*Primary Examiner*—David A. Scherbel
*Assistant Examiner*—Steven J. Ganey
(74) *Attorney, Agent, or Firm*—Harness,Dickey & Pierce P.L.C.

(57) ABSTRACT

A spinning wash nozzle assembly having a fluid brake pump within the rotating spinner housing. The fluid pump has a sump which is also within the rotating spinner housing such that centrifical forces acting on the fluid tend to separate the heavier fluid from any air within the sump. As a result, only the fluid is drawn into the pump as opposed to fluid and air. This avoids undesirable effects on the pump from air being drawn therein.

10 Claims, 6 Drawing Sheets

SPINNING WASH NOZZLE ASSEMBLY

This application claims benefit of provisional application Ser. Nos. 60/051,193 filed Jun. 30, 1997 and 60/057,301 filed Sep. 2, 1997.

BACKGROUND AND SUMMARY OF THE INVENTION

The present invention relates to a spinning wash nozzle assembly and in particular to a nozzle assembly having a liquid pump brake contained within a rotating spinner housing such that centrifugal forces separate the pumping liquid from air contained within the liquid to ensure that only the liquid is drawn into the pump.

A spinning wash nozzle assembly is known in the prior art from U.S. Pat. No. 5,020,556. This spinning nozzle comprises two main parts: 1) a rotating spinner head and shaft and, 2) a stationary housing providing bearing support for the rotating spinner head and shaft. Water enters the nozzle assembly through a fitting fastened to a support structure. A plurality of nozzles attached to the spinner head provide outlets for the pressurized water. The nozzles are set at an angle relative to the rotational axis of the spinner head such that the reaction forces from the water jets cause the spinner head to rotate about its axis. The rotational speed of the spinner head is controlled by a fixed displacement internal/external gear oil pump acting as a braking device by adjusting pump discharge flow pressure. The braking pump in this prior patent includes an inner gear coupled to the spinner head shaft for rotation therewith and an outer gear fixed to the housing. The housing further contains an oil sump for oil pumped by the braking pump. One problem associated with such a braking pump is the undesirable effect on the pump of air mixed within the oil.

The present invention provides a spinning wash nozzle assembly in which the braking pump as well as the fluid or oil sump for the pump are placed in the rotating spinner head and as opposed to the stationary housing as shown in the above referenced patent. This results in a simpler and a less expensive construction which has a further functional advantage. Due to the centrifugal effect on the rotating oil pump, any air present in the oil separates from the oil. The heavier oil moves radially outward while the lighter air moves radially inward, toward the axis. As a result, only oil is available at the pump inlet such that the oil drawn into the pump is free of air.

The pump is also configured with the inner gear held stationary while the outer gear is rotated. The discharge pressure of the oil pump is controlled by a pressure-regulating valve. The valve is biased either by a spring or by a centrifugally-generated force. In addition, temperature compensation can be provided through a bimetallic spring which produces a spring-force variable in relation to oil temperature.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
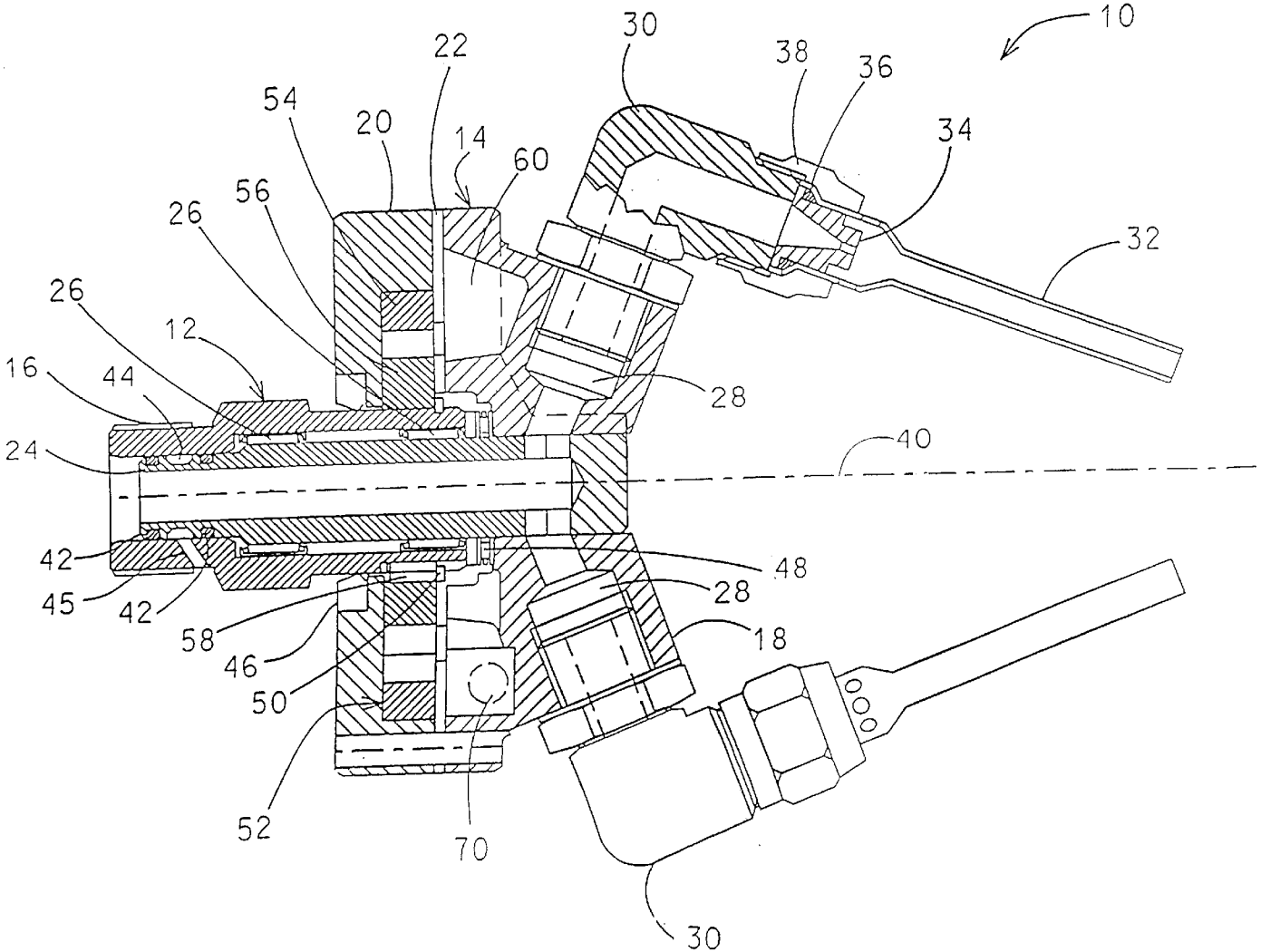
FIG. 1 is a sectional view of a spinning wash nozzle assembly of the present invention.

The spinning wash nozzle assembly of the present invention is shown in FIG. 1 and designated generally at 10. The assembly 10 consists of two main parts, a stationary first part or shaft 12 and a rotating spinner housing 14. The stationary shaft 12 is hollow and has an external threaded portion 16 to mount the assembly to a support structure.

The spinner housing includes a spinner head 18, a cover plate 20, a spacer plate 22 therebetween, and a spinner shaft 24 to rotatably mount the spinner housing to the stationary shaft 12. The spinner shaft 24 is disposed within the stationary shaft 12 and is supported by a pair of needle bearings 26. Water flows through the hollow spinner shaft 24 to four threaded, radial passages 28, only two of which are shown. Standard tube fittings 30 are threaded into the passages 28. A nozzle tube 32 with a nozzle 34 and a tapered sleeve 36 inserted therein are secured to the fitting 30 by a connector nut 38. Rotating motion of the spinner housing is achieved setting the nozzle tubes 32 in a position angular to the rotational axis 40 of the assembly. Reactional forces from the high pressure water jets create a moment that causes the spinner housing to rotate.

Two seals 42 disposed within grooves in the spinner shaft 24 and a vented groove 44 therebetween prevents high-pressure water from entering the oil-filled parts of the spinner. A vent passage 45 is provided to vent the groove 44. Lip seal 46 is pressed into the cover 20 to seal the oil filled pump cavity.

The axial force component from the water jet reaction force is taken to the stationary shaft 12 by needle-thrust bearing 48. Movement in the opposite axial direction is prevented by retaining ring 50 inserted in a groove formed in the stationary shaft 12.

An oil pump 52 in the spinner housing 14 is used as a brake to slow the spinner housing to a desired rotational speed. The pump operates in an oil-filled pocket formed in the cover 20 and consists of an outer gear 54, which in this case is the driving gear, and a stationary gear 56. The inner gear 56 is held stationary to the stationary shaft 12 by a key 58. The outer driving gear 54 is an internal gear while the inner gear 56 is an external gear. A typical arrangement for a gear pump uses the inner gear as the driving gear. In the present invention, it is the outer gear that is the driving gear. This inverted arrangement is advantageous because it increases the speed of the pump and allows for the use of a smaller displacement pump.

Figure 2:
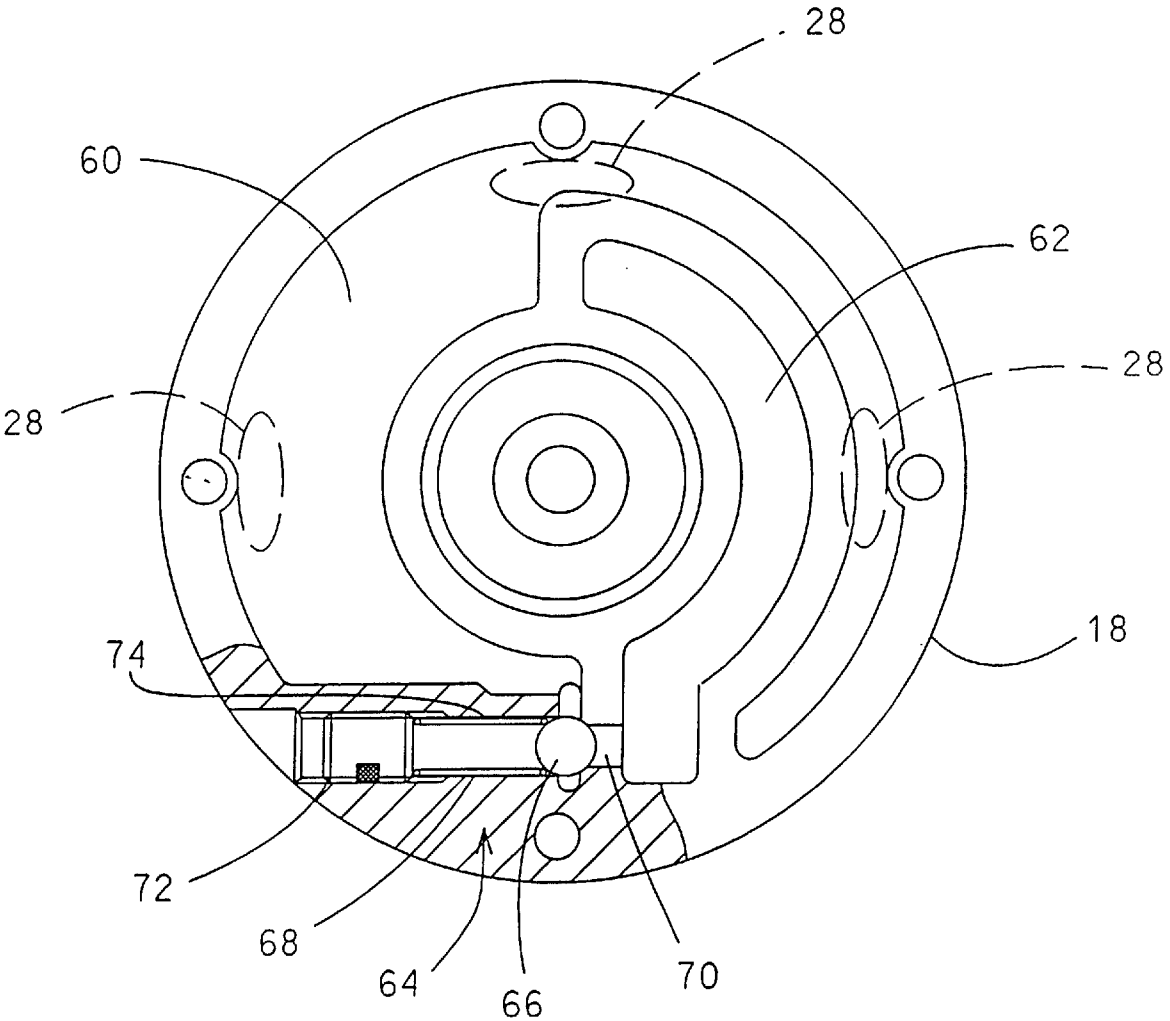
FIG. 2 is an axial view of the spinner head showing the oil sump and oil circulating passages of the braking pump.

The spacer plate 22 between the spinner head 18 and the cover 20 separates the oil pump from the oil sump 60 formed in the spinner head 18. The plate 22 also includes the inlet and outlet ports for the oil pump. Oil from the sump 60 enters the pump through the inlet port and leaves pressurized through the outlet port to the passage 62 leading to the pressure regulating valve 64 as shown in FIG. 2. This valve comprises of ball 66 and a bias spring 68 thrusting the ball against aperture 70 formed in a wall separating the sump 60 and the pump outlet passage 62. A threaded plug 72 sealed in the valve bore 74 is used to adjust the spring force for controlling the oil outlet pressure from the pump. The pump pressure determines the braking effort of the pump which determines the rotating speed of the spinner housing.

Because the oil sump 60 is rotating with the spinner housing, the centrifugal forces on the oil will cause the oil to move radially outward from the axis 40. The lighter air within the sump will be forced radially inward. By locating the pump inlet at a radial outward location, only oil is drawn into the pump. As a result, the undesired effects of air within the pump are eliminated.

Figure 3:
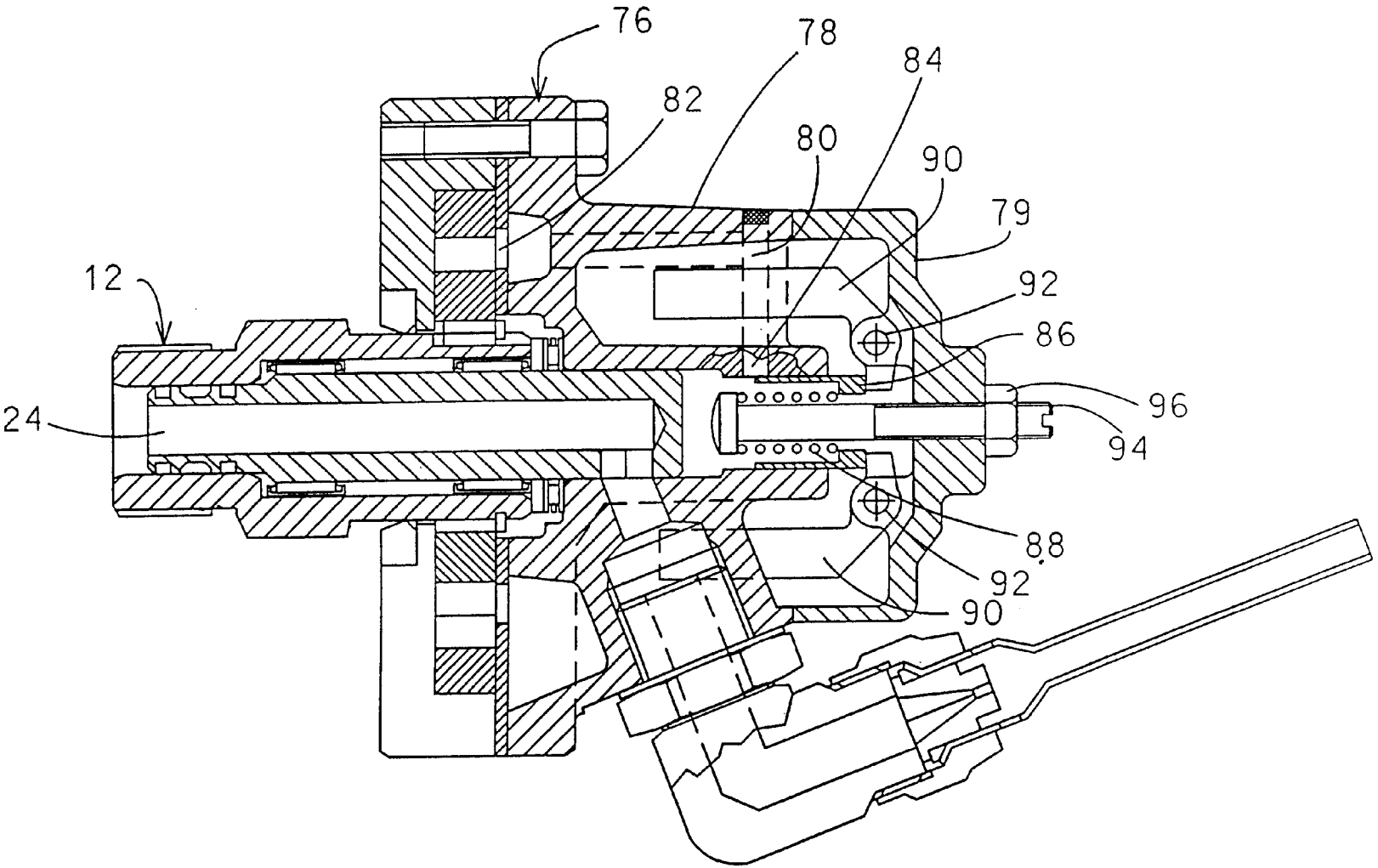
FIG. 3 is a sectional view of an alternative embodiment of a spinning wash nozzle assembly having a centrifugally controlled regulating valve.

An alternative embodiment of the invention is shown in FIG. 3 which features a closed-loop speed control system that should make all infield adjustment unnecessary. The spinner housing 76 includes a spinner head 78 and is mounted on a spinner shaft 24. The spinner head contains an oil passage 80 from the pump outlet 82. The passage 80 ends in a port 84 through which oil from the pump outlet must flow. A flow control valve spool 86 assumes a position which fully or partially covers the port 84. The spool 86 is positioned between a spring 88 and centrifugal weights 90. The centrifugal weights 90 are pivotally mounted to the spinner headcap 79 by pins 92. The weights create a force proportional to the spinner turning speed. The force of the weights thrust on one end of the spool 86 and are opposed to the force from the spring 88. The spool assumes the position where the two opposing forces are in equilibrium. The oil flow through the port 84 is dependent on the size of the uncovered portion of the port, pump speed and the discharge pressure of the pump. Desired speed can be attained by adjusting the spring force of the spring 88. This is done by turning the spring retaining screw 94 and locking it in a new position by the lock nut 96. Spinner headcap 79 is bolted to the front face of spinner head 78.

This speed control system is not as sensitive to part inaccuracies and environmental variations such as temperature. For example, if the pump becomes warm causing the discharge pressure to drop, the reduction in a braking effort will speed up the spinner. This results in adjustment of the spool position to reduce the size of the port 84. This causes the pressure in the pump to increase and increases the breaking effort to restore the original spinner velocity.

Figure 4:
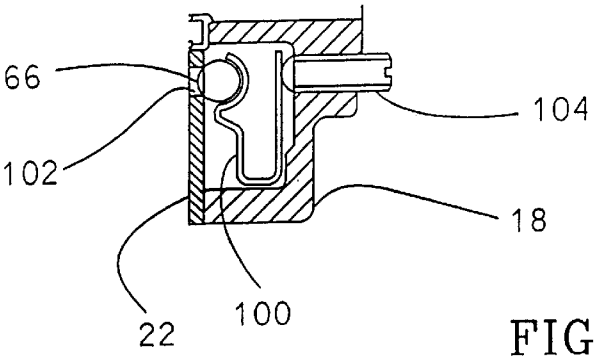
FIG. 4 is a fragmentary sectional view of an alternative embodiment of a braking pump pressure regulating valve showing a temperature compensating valve.

With reference to FIG. 4, an alternative embodiment of the oil pump pressure regulating valve is shown. When the temperature of the oil falls and its viscosity increases, the oil shear losses also increase, causing the spinner to turn at a slower speed. A thermostatic element acting on the pressure relief valve reduces the force acting on ball 66 which lowers the pump pressure causing the spinner to turn faster. A generally U-shaped spring 100 is used to hold a ball 66 into the pump outlet port 102 in the spacer plate 22. The spring force is in part controlled by the threaded plug 104. Temperature compensation is made by a bimetallic spring 100. The spring will change its force in proportion to temperature changes.

Figure 5:
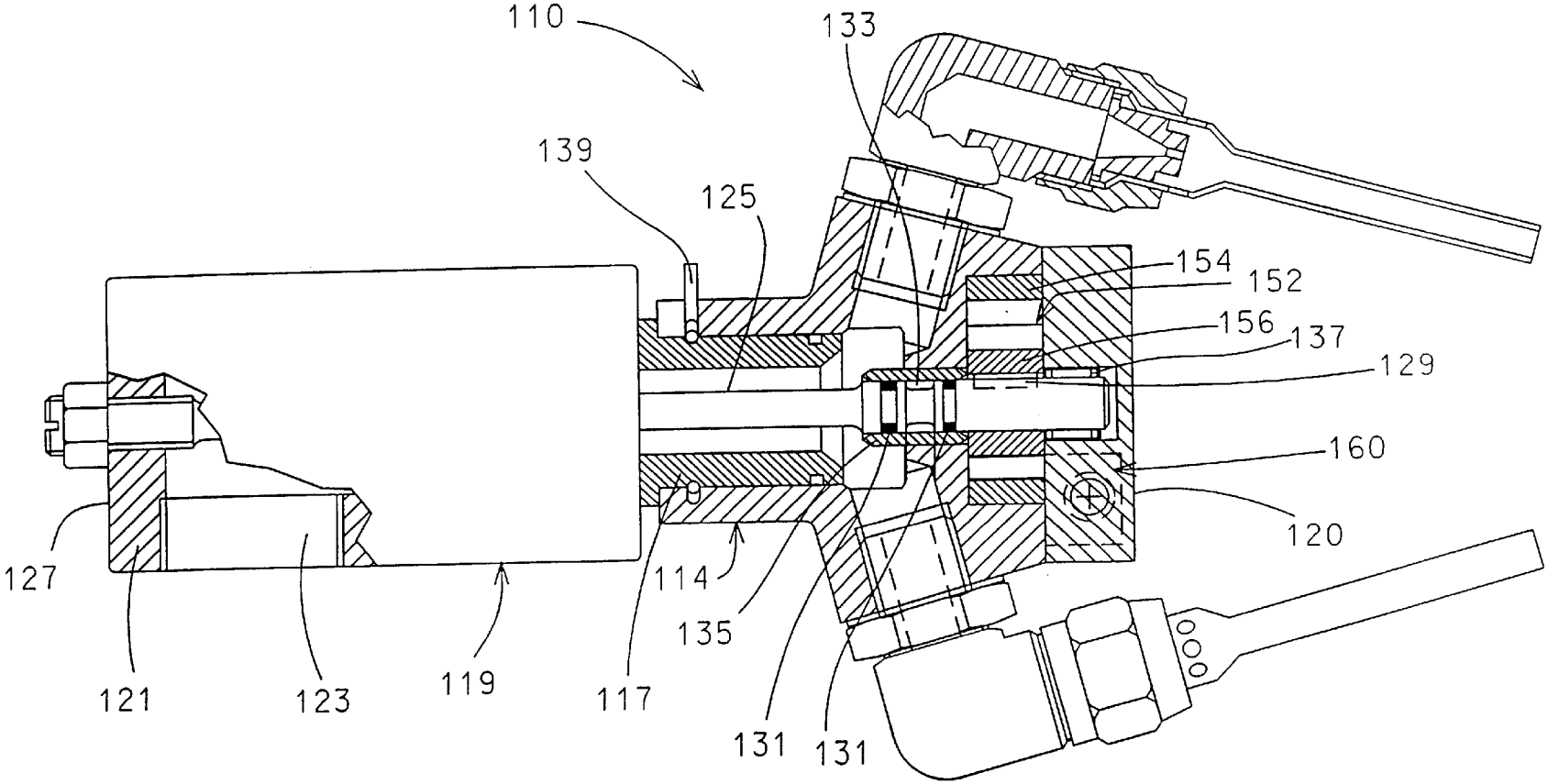
FIG. 5 is a sectional view of an alternative embodiment of the spinning wash nozzle assembly utilizing a commercial rotary union for mounting the rotating spinner head.

With reference to FIG. 5, yet another embodiment of the spinner wash nozzle assembly is shown. Components in the assembly 110 that are similar to components in the assembly 10 are given the same reference numeral plus 100. The assembly 110, like assembly 10, includes an oil pump 152 within the rotating spinner housing 114. The oil pump includes an outer gear 154 and an inner gear 156. The pump further includes a sump 160.

The rotating spinner housing 114 is mounted to the rotating union output shaft 117 of a commercially available rotary union 119. The union 119 includes a housing 121 with a water inlet 123. Water flows through the hollow rotating output shaft 117 and enters the spinner housing 114.

A stationary shaft 125 is attached to the union housing 121 at the housing end 127. The shaft extends through the union and into the rotating spinner housing. The shaft is coupled to the pump inner gear 156 by a key 129. The shaft holds the inner gear stationary. Two seals 131 are placed in grooves in the shaft 125 and a vented groove 133 is placed therebetween to prevent high pressure water from entering into the pump cavity. The seals 131 run against the inner surface of a sleeve 135 pressed into the body of the spinner housing. The shaft 125 is supported by a needle bearing 137 pressed into the cover 120.

The spinner housing is secured to the output shaft 117 of the union by a retaining ring 139. The rotary union 119 provides rotary support for the output shaft 117 and, by virtue of its commercial availability, reduces the overall cost of the wash nozzle assembly. Like the embodiment shown in FIG. 1, the oil pump and its sump are located in the rotating spinner housing such that the oil and air are separated and only oil is drawn into the pump.

Figure 6:
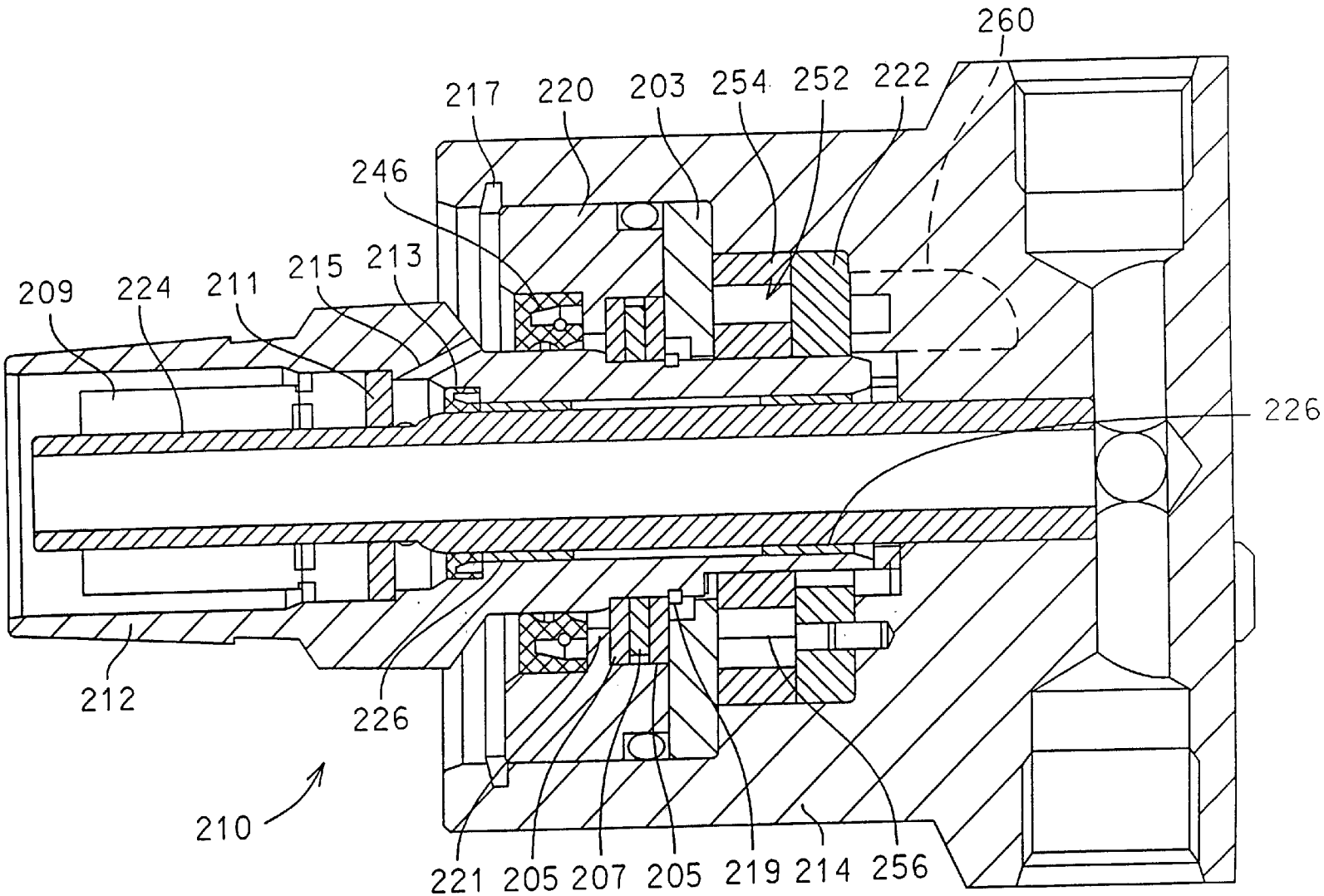
FIG. 6 is an axial view of another embodiment of the spinner wash nozzle assembly of the present invention.

FIG. 6 shows yet another embodiment of the spinner of the present invention which is constructed in such a manner to provide for relatively easy assembly. Components of the assembly 210 that are similar to components in assembly 10 are given the same reference numeral plus 200. The assembly 210, like assembly 10, includes an oil pump 252 within the rotator spinner housing 214. The gerotor type oil pump includes an outer gear 254 and an inner gear 256.

The rotating spinner housing 214 is coupled to the rotating shaft 224 which is mounted into a fixed shaft 213 upon needle bearings 226.

A spinner port plate 222 is provided, adjacent to the gears 254 and 256, which contains the inlet and outlet openings to the pump. On the opposite side of the pump gears is a plate 203 which bears against the cover 220 closing the spinner housing 214. The cover 220 is retained axially in place on the spinner housing by a tapered snap ring 217.

A lip seal 246 is provided between the cover 220 and the stationary shaft 212. A thrust bearing 207 is positioned between two thrust washers 205 and are retained against a ledge on the stationary shaft 212 by a snap ring 219. A shoulder 221 of the cover 220 bears against one of the thrust washers 205 to carry thrust load from the spinner housing to the stationary shaft 212.

A face seal 209 is provided at the interface between the rotating shaft 224 and the fixed shaft 212. This prevents water from entering into the needle bearings and ultimately into the oil pump. A vent port 215 is provided to allow any high pressure water that has passed the face seal to drain rather then entering past the lip seal 213 into the needle bearings.

Figure 7:
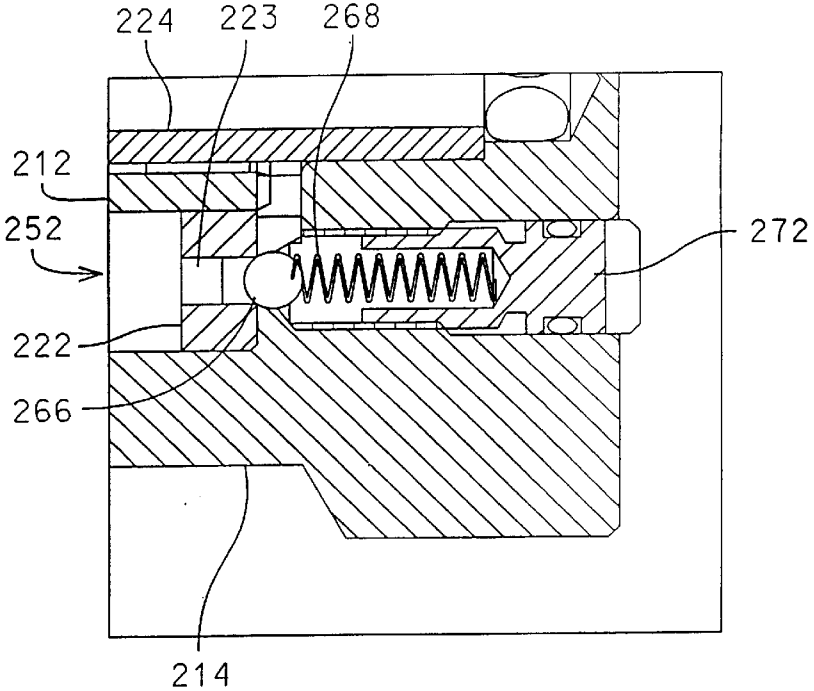
FIG. 7 is a sectional view of an oil pressure check valve for speed control of the spinner wash nozzle assembly shown in FIG. 6.
Figure 8:
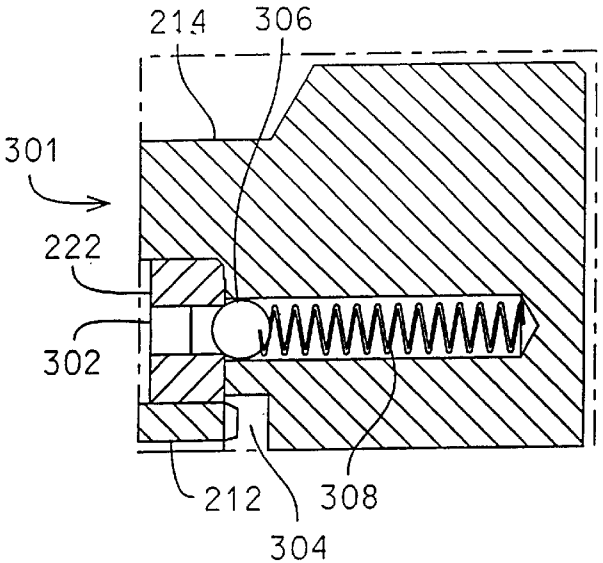
FIG. 8 is a sectional view of a back flow pressure relief valve.

The pressure control valve shown in FIG. 7 controls the pump output pressure and thus controls the speed of the spinning nozzle assembly. The port plate 222 contains a pump high pressure outlet port 223 which is closed by a ball 266. A spring 268 bears against the ball to hold it in a closed position against the port 223. The spring force is adjustable by a threaded plug 272. A back flow pressure relief valve 301 is shown in FIG. 8. The port 302 is on the suction side of the oil pump during normal operation. The port 304 is on the high pressure side of the oil pump. During normal operation of the pump, the ball 306 closes the port 302 and prevents oil flow through the valve. However, in the event the spinner is manually rotated in the opposite direction from normal operation, the suction side of the pump will be pressurized. The valve 301 is provided to relieve pressure on the suction side of the pump. If not relieved, the pressure can blow out the seals in the spinner assembly, which are designed to be on the suction side of the pump. The spring 308 provides a relatively low force to be overcome by the oil pressure such that the pressure is relieved at a low level. Thus there can be no pressure build up in the oil sump and in the area connected thereto thereby preventing the oil seals from being blown out.

The spinner assembly 210 is disassembled by removal of the snap ring 217 allowing the spinner housing 214 to be removed and access gained to the internal components of the spinner assembly. The spinner housing 214 includes the oil sump for the pump, thus providing the advantages of the present invention in that the oil sump is rotating, enabling separation of oil and air.

It is to be understood that the invention is not limited to the exact construction illustrated and described above, but that various changes and modifications may be made without departing from the spirit and scope of the invention as defined in the following claims.

What is claimed is:

1. A water nozzle assembly comprising;

a stationary first part;

a spinner housing mounted to the first part for rotation about an axis;

at least one nozzle extending from the spinner housing through which water is sprayed at an angle to the axis such that reaction forces create a moment that causes the spinner housing to rotate about the axis;

a fluid pump brake means with a fluid sump in the spinner housing whereby the centrifugal effect of the rotating sump causes the fluid to move radially outward and any air in the fluid to move radially toward the axis leaving fluid drawn into the pump brake means free of air; and pressure regulating means for regulating output pressure of the fluid pump brake means, said pressure regulating means including a valve having means urging the valve to vary the force of the fluid from the pressure regulating means on said brake means.

2. The assembly of claim 1 wherein the fluid pump brake means includes an internal/external gear pump.

3. The assembly of claim 2 wherein the internal gear is driven by the rotating spinner housing and the external gear is held fixed to the stationary first part.

4. The assembly of claim 1 wherein the means urging the valve to vary the force of fluid from the pressure regulating means is responsive to the temperature of the pumped fluid.

5. The assembly of claim 1 wherein the means for urging the valve to vary the force of the fluid from the pressure regulating means varying is responsive to the rotational speed of the spinner housing.

6. The assembly of claim 1 wherein the stationary part includes a union having a fixed housing and a rotating output shaft to which the spinner housing is attached for rotation along with the output shaft of the union.

7. The assembly of claim 6 wherein the fluid pump brake means includes an internal/external gear pump and the union includes a fixed shaft extending from the union housing into the spinner housing and attached to a gear of the gear pump to hold the attached gear fixed to the union housing.

8. The assembly of claim 7 wherein the fixed shaft of the union extends through the spinner housing to a distal end and further comprising a cover fixed to the spinner housing to cover the distal end of the fixed shaft.

9. The assembly of claim 8 wherein the fluid pump brake means is disposed between the at least one nozzle extending from the spinner housing and the cover fixed to the spinner housing.

10. The assembly of claim 1 wherein the stationary first part is a fixed hollow shaft with a spinning shaft extending therethrough and beyond one end of the fixed shaft, the spinner housing is coupled to the spinning shaft and the fluid pump brake means includes a gear pump having an external gear mounted to the fixed shaft and an internal gear mounted to the spinner housing.

* * * * *